United States Patent [19]

Debenham

[11] 3,972,445

[45] Aug. 3, 1976

[54] EASY-OPENING CONTAINER ENDS

[75] Inventor: Michael Debenham, Frankston, Australia

[73] Assignee: The Broken Hill Proprietary Company Limited, Melbourne, Australia

[22] Filed: Apr. 7, 1975

[21] Appl. No.: 565,702

[30] Foreign Application Priority Data

Apr. 5, 1974 Australia ..... 7178/74

[52] U.S. Cl. ..... 220/268; 220/334

[51] Int. Cl.² ..... B65D 41/32

[58] Field of Search ..... 220/265, 268, 334, 359; 113/121 C

[56] References Cited

UNITED STATES PATENTS

| | | | |
|---|---|---|---|
| 2,261,117 | 11/1941 | Jack, Jr. | 220/268 |
| 3,334,775 | 8/1967 | Klein et al. | 220/268 |
| 3,741,432 | 6/1973 | Werth | 220/268 |
| 3,843,011 | 10/1974 | Perry | 220/265 X |

*Primary Examiner*—George T. Hall

*Attorney, Agent, or Firm*—Murray and Whisenhunt

[57] ABSTRACT

This specification discloses a can end having push-in closures, one closures being smaller than the other for venting and/or pressure releasing purposes. At least the smaller closure having a supplementary sealant connection about which the closure hinges when it is opened. The supplementary sealant connection acts to prevent the closure becoming detached from the can end in the event that the main hinge for the closure is broken. The supplementary connection is achieved either by extending the sealant to cover an adjacent surface of the closure in a direction away from the connection or by increasing the thickness of the sealant covered in the area of the main hinge.

5 Claims, 4 Drawing Figures

EASY-OPENING CONTAINER ENDS

This invention relates to easy-opening can ends for beverage containers, and more particularly to can ends of the type including two push-in closures, one closure being smaller than the other for venting and/or pressure releasing purposes.

The push-in closures formed in the can end are both usually integrally connected to the end by a neck of sheet metal which serves as a hinge when the closures are opened. In the case of the small closure there is a remote possibility that the metal neck may break allowing the closure to drop into the can. Since this closure is small enough to pass through the large opening it may be swallowed by a drinker. Even though the possibility of this occurring is very remote it is important that the possibility be removed for normal conditions of use and this is the object of the present invention.

It is also desirable to prevent the detachment of the large closure and the invention is equally applicable to single closure ends and double closure ends in which the closures are of the same size.

The present invention provides an easy-opening can end including at least one closure having a connection to the can end about which the closure hinges when it is pushed into the can to open the closure, said closure being characterised by a supplementary connection of sealant or equivalent adhesive material of the required strength and flexibility in the region of said connection and about which the closure hinges when it is opened.

In one form of the invention the supplementary connection comprises a coating of sealant which covers said connection and extends over the adjacent surface of the closure in a direction away from the connection.

Preferably the connection is an integral neck of the metal of said end and the sealant or equivalent extends in a direction generally perpendicular to the axis about which the closure hinges.

In another form of the invention the supplementary connection comprises part of a sealant or equivalent cover for said closure, said part being of increased thickness relative to the remainder of said cover.

The invention is applicable to all forms of push-in closures including those that are severed from the can end except for the hinge-defining neck and those that are defined by score lines, or combinations of both.

In the case of closures including severed metal, sealant is usually applied around the closure on the inside face of the end.

To apply the invention to such a closure it is simply necessary to extend the area of application of the sealant in the region of the hinge-defining neck.

Where the closure is scored, the sealant or equivalent need only be applied to cover the hingedefining neck.

Preferred forms of the invention are shown in the accompanying drawing in which.

Figure 1:
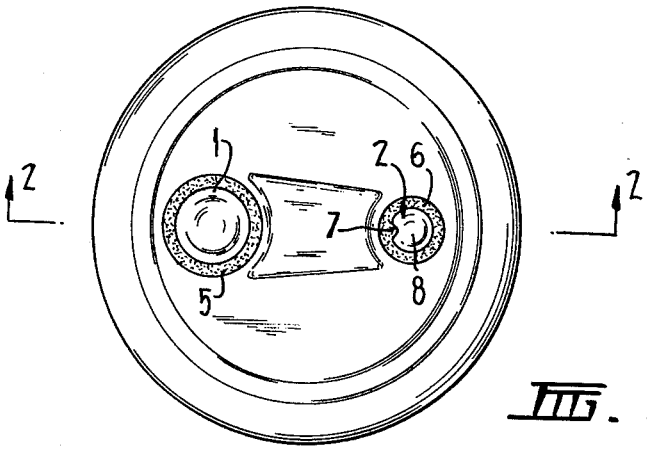
FIG. 1 is a plan view of the underneath side of an easy-opening can end.
Figure 2:
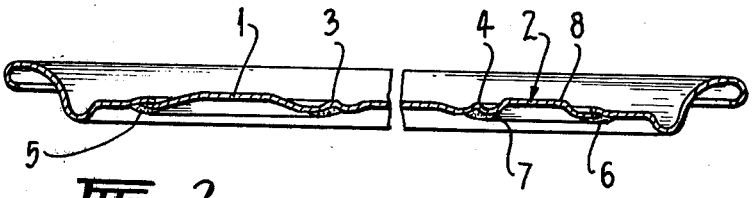
FIG. 2 is an enlarged fragmentary sectional elevation along line 2-2 of FIG. 1.
Figure 3:
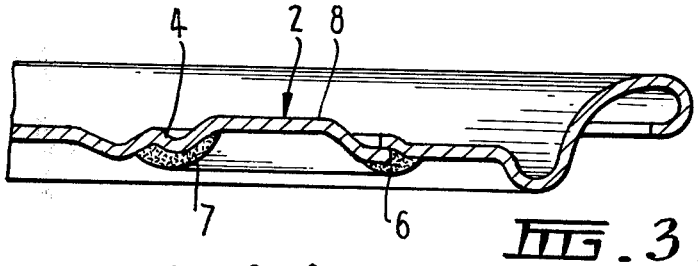
FIG. 3 is a further enlarged fragmentary sectional elevation of the smaller closure in FIGS. 1 and 2.

The end shown includes two push-in closures 1 and 2, closure 2 being a smaller venting/pressure releasing closure. The closures 1 and 2 are formed by the method described in U.S. Pat. No. 3,759,206 and they remain connected to the end by integral necks of metal 3 and 4 which act as hinges when the closures are opened.

The closures 1 and 2 are hermetically sealed in the end by means of generally annular areas of sealant 5 and 6 applied to cover the overlapping and adjacent areas of the closures and the can end. It will be appreciated that the sealant areas shown in the drawings are exaggerated in dimensions for extra clarity.

The sealant area 6 for the small closure 2 is extended at 7 to define a closure retaining "sealing hinge" or supplementary hinge which will act to retain the closure 2 on the end in the event that the neck 4 fractures.

It will be noted that the closure is formed with a central upwardly raised section 8. The sealant is preferably allowed to flow into this section to further key the extended sealant portion 7 to the closure 2.

The sealant areas 5 and 6 are preferably applied by one of the methods described in co-pending application Ser. No. 466,057, but other methods may be used. The applicator for area 6 is modified to cover area 7 and extends just to the edge of raised section 8 so that the sealant applied flows over the edge into the raised section 8.

The sealant material used in the preferred form is a pvc plastisol. However, other forms of sealant, such as other plastisols, may be used quite successfully provided they are flexible and strong enough to resist the opening operation without fracturing. It is believed that most thermoplastics materials would have the necessary qualities. In the case of a scored closure, an adhesive tape may even be used provided it remains adhered under the conditions prevailing inside the can.

The thickness of the sealant applied in normal circumstances is usually less than 0.005 inch but to ensure that there is no reasonable likelihood of fracture it is proposed to apply the sealant, at least in area 7, to a thickness exceeding 0.005 inch. These thicknesses are fairly arbitrary and would normally be determined experimentally having regard to the size of the closure and the sealant used.

The sealant area 5 may be similarly modified to include an extended area similar to 7.

Figure 4:
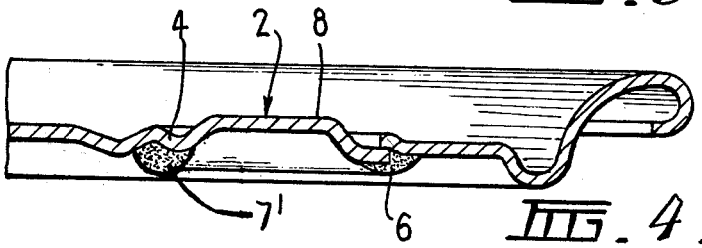
FIG. 4 is an enlarged fragmentary sectional elevation similar to FIG. 3 of an alternative form of the invention.

In the alternative form shown in FIG. 4, the extended area 7 of the first embodiment is replaced by a sealant section 7' of increased thickness extending for at least the width of neck 4. Once again, the increased thickness and width necessary is determined experimentally having regard to the size of the closure and the sealant used.

I claim:

1. An easy opening push-in metal can end including at least one opening and closure therefor, and closure being severed from the can end except in a hinge area wherein said closure is connected to the remainder of said can end by a hinge connection of unsevered metal about which the closure hinges when it is pushed into the can to open same, the edge of the closure and the edge of the can end surrounding the opening in contact or in close proximity so as to form a juncture when the closure is in the closed position, a sealant applied around the juncture of said closure and the edge of the can end surrounding said opening, and a supplementary connection of sealant comprising a section of sealant in the region of said hinge connection, said section of increased strength relative to the remainder of said sealant, said section being wider than the remainder of said sealant by extending over the adjacent surface of said closure in a direction away from said hinge connection, said section of sealant being sufficiently flexible to permit hinging of said closure when it is opened and being of sufficient increased strength to substantially reduce the likelihood of detachment of said closure from said end in the event that said hinge connection is broken.

2. Can end of claim 1, wherein the closure hinges about an axis upon opening, and said section extends in a direction generally perpendicular to said axis.

3. Can end of claim 1, wherein said can end includes at least two openings and closures therefor, one closure being a smaller venting/pressure releasing closure, at least said smaller closure having said supplementary connection of sealant.

4. Can end of claim 3, wherein said sealant is a pvc plastisol.

5. Can end of claim 1, wherein said sealant is of pvc plastisol.

* * * * *